United States Patent [19]

Wilson

[11] Patent Number: 4,669,294

[45] Date of Patent: Jun. 2, 1987

[54] ROLLING MILL STAND

[75] Inventor: Alexander I. Wilson, Sheffield, England

[73] Assignee: Davy McKee (Sheffield) Limited, Sheffield, England

[21] Appl. No.: 885,004

[22] Filed: Jul. 14, 1986

Related U.S. Application Data

[63] Continuation of Ser. No. 678,457, Dec. 5, 1984, abandoned.

[30] Foreign Application Priority Data

Dec. 9, 1983 [GB] United Kingdom ..... 8332972

[51] Int. Cl.[4] ..... B21B 35/14; B21B 31/00

[52] U.S. Cl. ..... 72/249; 72/238

[58] Field of Search ..... 72/249, 237, 238, 239, 72/235, 247

[56] References Cited

U.S. PATENT DOCUMENTS

| | | | |
|---|---|---|---|
| 2,240,362 | 4/1941 | Backhaus | 72/249 |
| 2,870,664 | 1/1959 | Lobkowitz | 72/247 |
| 4,098,107 | 7/1978 | Bruno | 72/237 |

FOREIGN PATENT DOCUMENTS

| | | | |
|---|---|---|---|
| 130704 | 8/1982 | Japan | 72/238 |
| 130705 | 8/1982 | Japan | 72/238 |

*Primary Examiner*—Robert L. Spruill
*Assistant Examiner*—Steve Katz
*Attorney, Agent, or Firm*—Lee, Smith & Zickert

[57] ABSTRACT

A rod or bar mill stand (72) is constructed to be used either in vertical or horizontal disposition. When in the horizontal disposition the rolls (3) are driven directly by the usual drive consisting of motor, pinion box and drive spindles which are arranged at the same general level as the stand. When the stand is in the vertical disposition, a drive adaptor (50) is introduced to transmit the drive from the drive spindles to universal spindles (71) arranged about the stand (72) to connect to the necks of the rolls (3).

8 Claims, 8 Drawing Figures

ROLLING MILL STAND

Figure 1:
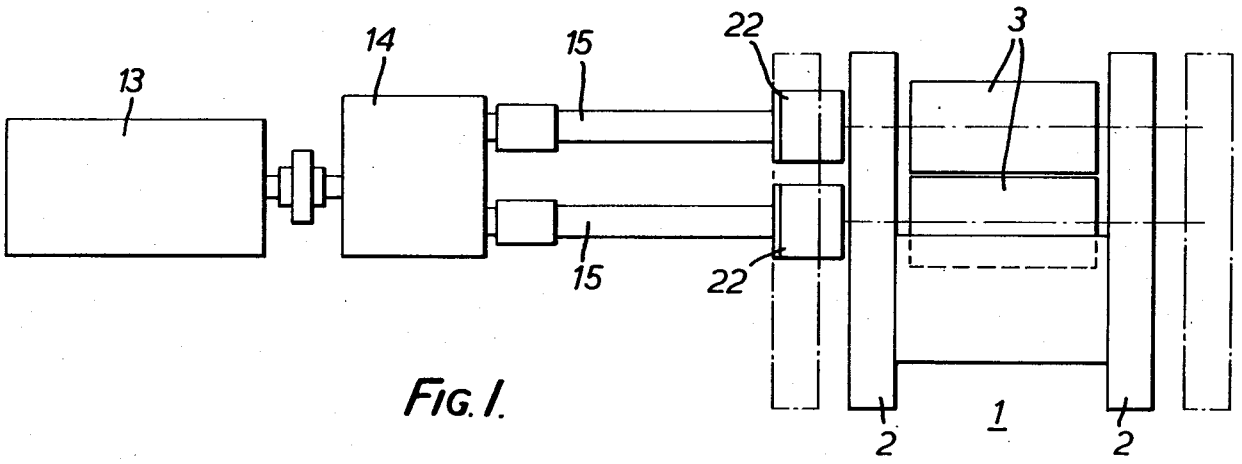

This application is a continuation of U.S. patent application Ser. No. 678,457, filed Dec. 5, 1984, and now abandoned.

This invention relates to a rolling mill stand, and particularly one that can be employed with the axes of its rolls either vertical or horizontal.

Continuous mills, for rolling rod, bar, sections or beams, for example, often employ vertical stands, as well as the normal horizontal stands, to avoid twisting of the product between stands. That is necessary when rolling, for example, an oval square or oval round type sequence, to provide edging passes when rolling flats, and to provide vertical passes when rolling some sections such as T's and the like.

The position of the vertical stands in the mill train varies from product to product. For example when rolling channels and angles by the gothic method, the last stands (usually six or eight) require to be all horizontal, whereas, when rolling T's, the last five stands may be required to be alternately horizontal and vertical.

To avoid the need to provide both a vertical stand and a horizontal stand at each stand location in the train, an expedient which is expensive both in capital cost and space and makes rolling cumbersome, at least some of the stands of the train should be capable of rolling either horizontally or vertically, the stands being mounted either with the axes of the rolls horizontal or with those axes vertical. However, with such a convertible stand, there have been serious problems with the drive to the rolls. Thus, the stand can have separate drives in the two positions, two drive motors being provided, or permanent bevel drives may be coupled by relatively long shafting to a single motor. All expedients are however expensive and involve a considerable amount of additional fixed equipment, services and the like. If the stand, when in the vertical attitude, is driven from above ('overdriven'), particularly with a top mounted motor, considerable headroom is required. Similarly, having the drive below the stand ('underdriven') requires deep foundations and results in the drive equipment operating under hostile conditions.

The invention resides in rolling mill equipment comprising a rolling mill stand adapted to operate in either a horizontal disposition or a vertical disposition in which the axes of the rolls are horizontal and vertical respectively, and a drive mechanism including a drive motor and drive spindles arranged to drive the rolls directly when the stand is in the horizontal disposition, characterised by adaptor means for use only when the stand is in the vertical disposition for transmitting drive from at least one of the spindles to the rolls without modification of the drive mechanism, the drive spindles being telescopic and angularly variable, to accommodate adjustment of the stand axially of the rolls, respectively when the stand is in the horizontal disposition and when the stand is in the vertical disposition.

By the use of the adaptor mechanism, the principle drive equipment—the motor and spindles—can be arranged at the same level as the stand, the expense of fixed drives to the rolls when in vertical attitude is avoided, and the space required above and below the stand is minimized.

When the stand is adjusted parallel to the axes of the rolls to select a particular pass along the roll barrels, the movement is accommodated by the telescoping of the drive spindles, when the stand is in its horizontal disposition. When the stand is in its vertical disposition, the corresponding movement of the stand is accompanied by changes in the angular positioning of the drive spindles, and for that purpose the drive spindles are capable of operating with a relatively high angularity.

Figure 2:
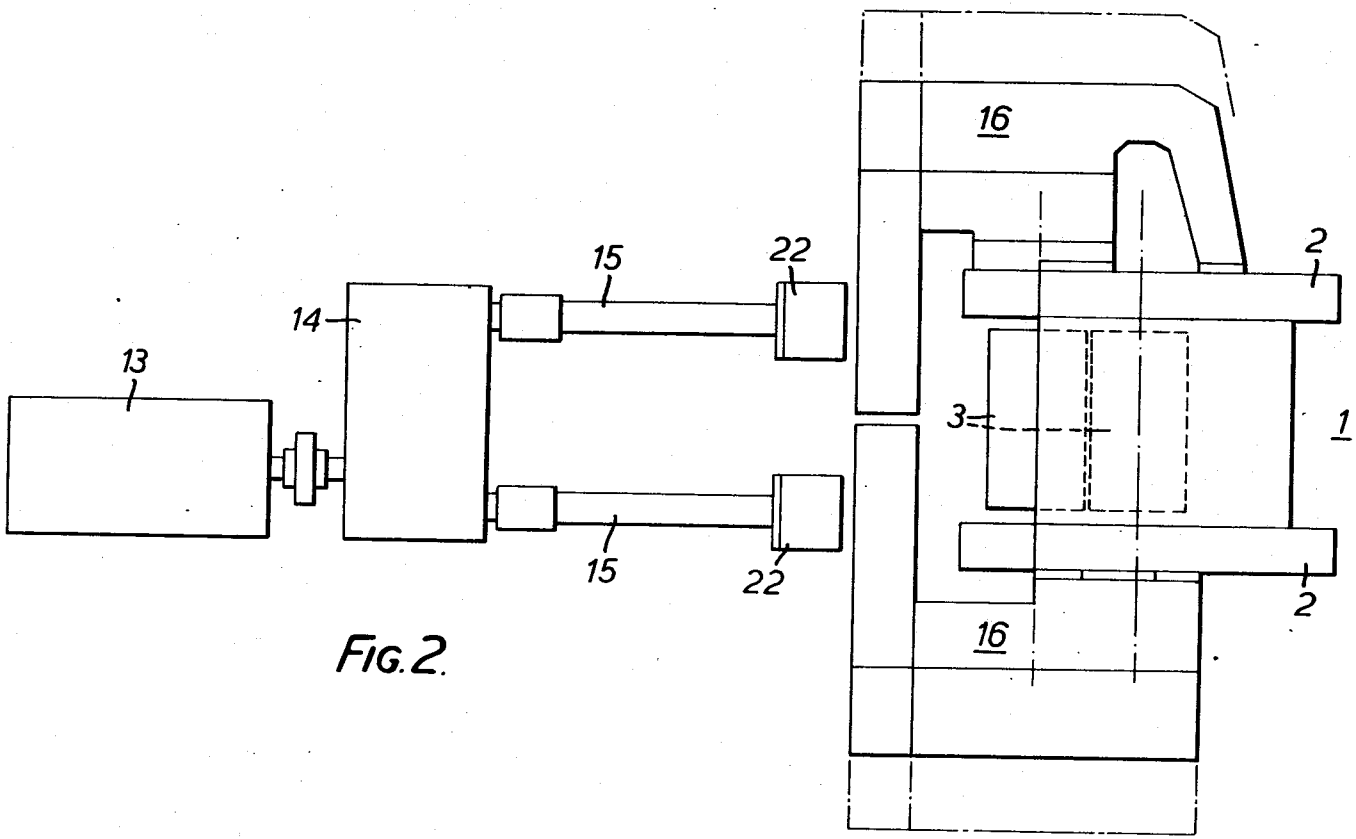
Figure 3:
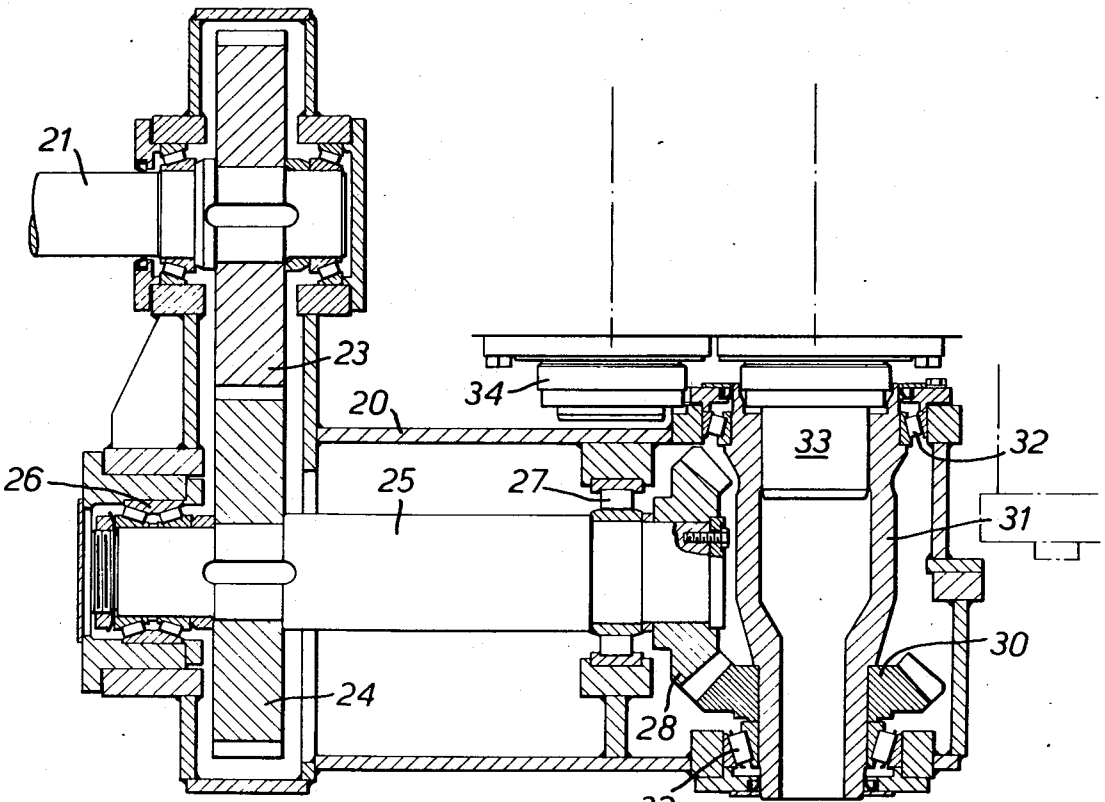
Figure 5:
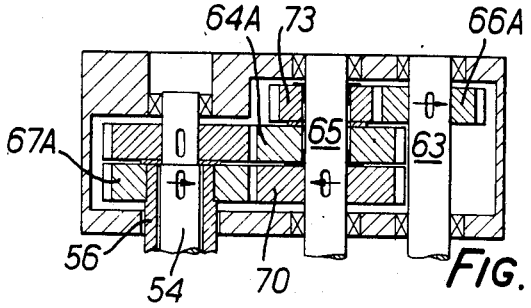
Figure 4:
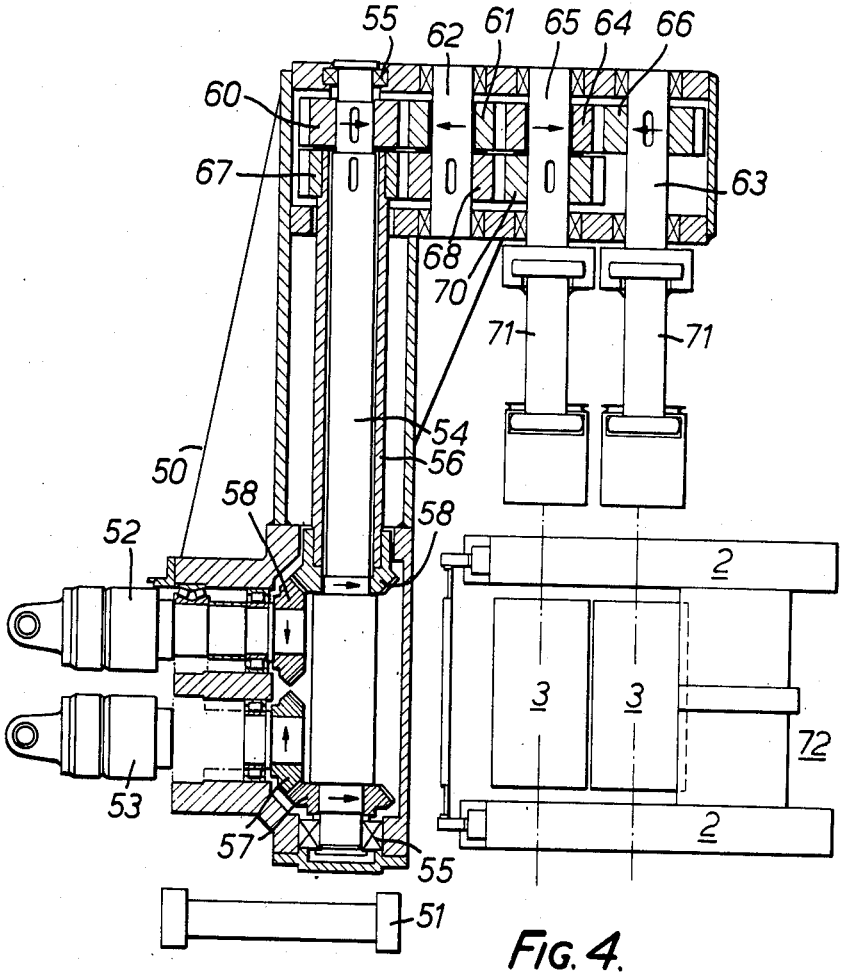
Figure 6:
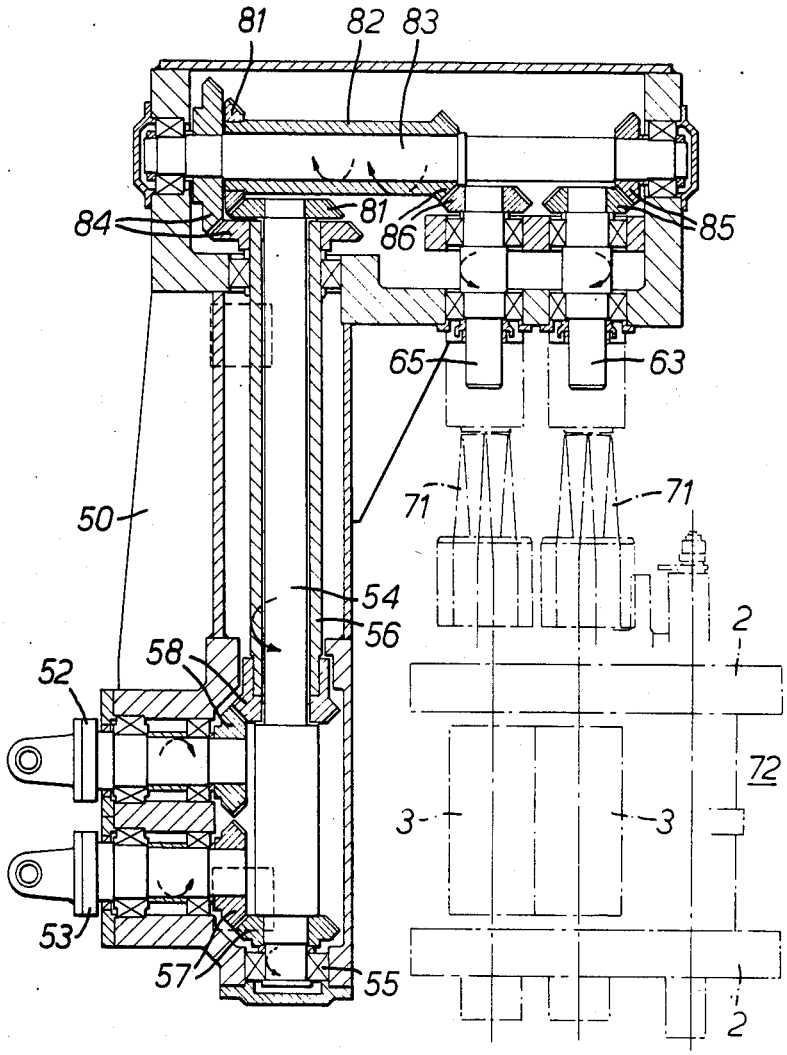
Figure 7:
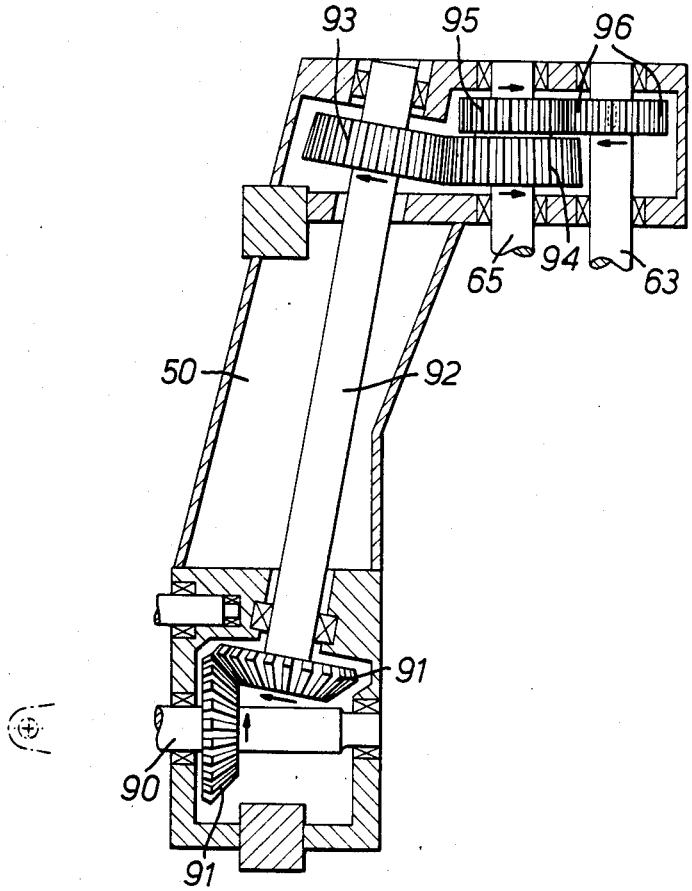
Figure 8:
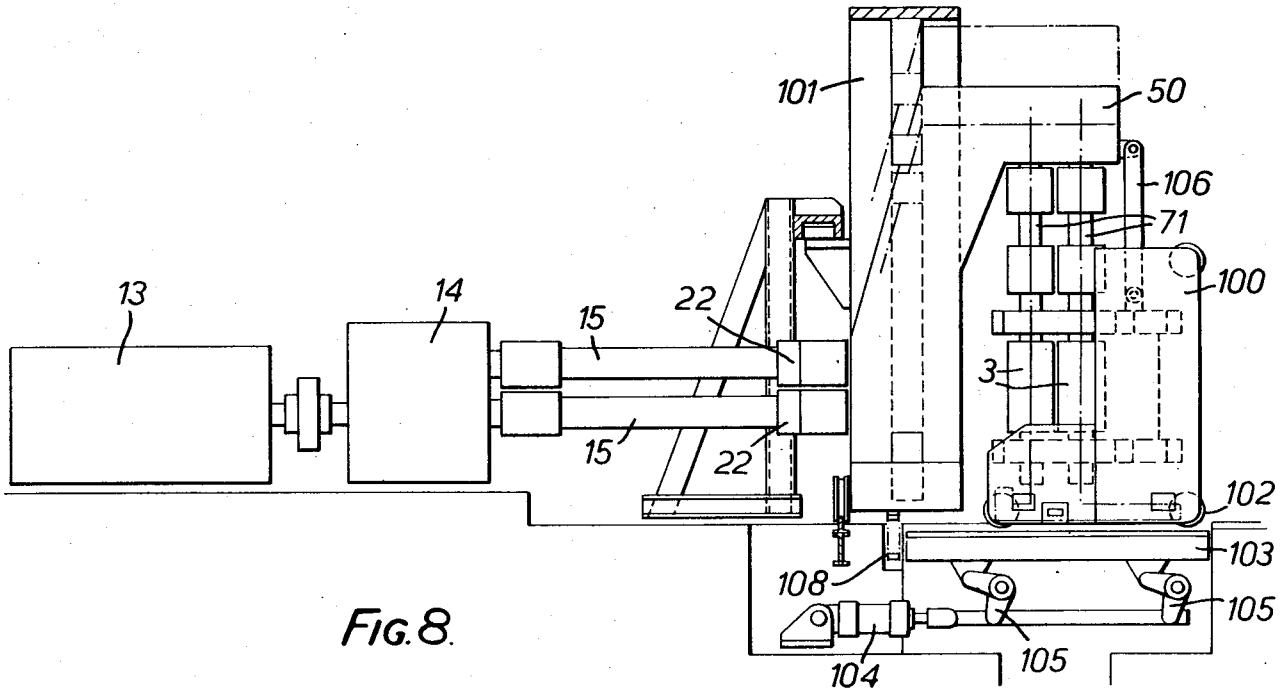

The invention will be more readily understood from the following description of a rolling mill stand and its drive, in accordance therewith, reference being made to the accompanying drawings, in which FIGS. 1 and 2 diagrammatically illustrate the stand and drive when the axes of the rolls are respectively horizontal and vertical, FIG. 3 is a vertical section showing one of the drive adaptors of FIG. 2, FIG. 4 illustrates adaptor means in the form of a gear unit, FIGS. 5 to 7 show modifications of the gear unit of FIG. 4, and FIG. 8 shows the stand, its drive and a gear unit adaptor.

In FIGS. 1 and 2, the rolling mill 1 stand is represented by its housing 2 and its rolls 3. The stand is here illustrated as a rod or bar mill with a number of passes along the barrels of the rolls, any pass along the roll barrel being selected by the movement of the stand parallel to the roll axis. The stand may be of the prestressed type, with T-headed chocks for one roll prestressed on to the housings and the chocks for the other roll being adjustable in the housing by means of screw or wedge mechanisms.

The drive for the stand consists of the usual drive motor 13, a pinion stand 14 and drive spindles 15 connecting the pinion stand to the drive ends of the rolls 3 through universal couplings 22. In order to accommodate the axial adjustment of the stand 1, when used for horizontal rolling, the spindles are telescopic, while, in order to accommodate the similar adjustment movement when the stand is used for vertical rolling, the universal couplings are capable of driving at a relatively wide angle.

The stand 1 is mounted so as to be capable of being moved between the horizontal disposition shown in FIG. 1, in which the roll axes are horizontal, and the vertical disposition of FIG. 2, in which the roll axes are vertical. When in the latter disposition the drive from the spindles 15 is transmitted to the rolls through two detachable adaptors 16 mounted on the housings 2 and arranged one above and one below the stand 1 and driving the left-hand and right-hand rolls 3, respectively. The construction of the lower adaptor is shown in greater detail in FIG. 3, it being understood that the mechanical arrangement of the upper adaptor is similar.

The adaptor shown in FIG. 3 has a fabricated housing 20, in which are journalled the gears necessary to transmit the drive. An input shaft 21 from the lower universal coupling 22 (FIGS. 1 and 2) enters the housing 20 and carries a first gear 23 meshing with a second gear 24 which is keyed on a shaft 25 mounted in bearings 26, 27. At the right hand end, the shaft 25 carries a bevel gear 28 engaging a second bevel gear 30 which is fast on a sleeve 31. Sleeve 31 is carried in bearings 32 and receives the roll neck 33 of the right-hand roll 3 (FIG. 2). The lower roll neck 34 of the left-hand roll 3 is also shown, it being understood that that roll is driven at its other, upper, roll neck.

The upper adaptor differs from that shown in FIG. 3 only in the connection between shaft 25 and sleeve 31. In order that the two rolls may rotate in opposite senses the bevel gear 30 is attached to the sleeve 31 adjacent the roll neck 33, meshing with gear 28 on the side of the shaft axis opposite to that shown in FIG. 3.

For horizontal rolling (FIG. 1), the adaptors 16 are not employed and, as before mentioned, axial adjustment of the stand in order to select the requisite pass is effected by moving the stand, the movement being accommodated by the telescopic spindles. In order to convert to a vertical stand (FIG. 2), the roll necks are disconnected from the universal couplings 22 and the stand 1 is turned through 90°. The adaptors 16 are mounted on the stand and connected to the couplings 22 and to the roll necks as described above. Pass selection is again effected by axial movement of the stand, with variation of the angularity of the spindles 15.

The use of the adaptors 16 has a number of advantages:

1. The adaptors are not permanent fixtures and can therefore be rated higher than fixed gear boxes for the same purpose, with consequential saving in weight and expense.
2. The vertical stand entablature is very simple.
3. The design facilitates stand changing and also train changing, thus allowing all interstand equipment to be set up off the mill line. That in turn makes it economical to roll small quantities in a continuous mill.
4. The design has all the advantages of fixed guides with axially adjustable stands facilitating quick pass adjustment into the constant rolling line, without the need to move the guides. Usually it takes longer to change a vertical stand than a horizontal stand, but in the present arrangement there is little difference between the two.
5. The arrangement can be used to extend and/or improve the use of existing horizontal stands by making any number of stands in a train convertible either to permanent or occasional vertical orientation.
6. The drive is horizontal, i.e. at the same level as the stand, whether the stand is used for vertical rolling or horizontal rolling. Little space for the drive gear is then required either above or below the stand.

In the alternative adaptor means of FIGS. 4 to 8 the two adaptors 16 of the previous Figures are replaced by a small wheel-mounted gear unit which can be traversed in line with any stand of the train, when that stand is to be employed in vertical disposition.

The gear unit of FIG. 4 comprises a sub-housing 50 mounted in a tower frame having wheels 51. The sub-housing 50 can be traversed by a rack (shown at 108 in FIG. 8) into operative position relative to the vertically disposed stand shown schematically at 72. When in that position, the gear unit is coupled to the stand, as in the manner to be described in relation to FIG. 8, so that movement of the stand for pass selection is accompanied by movement of the gear unit.

In the sub-housing 50 are journalled a pair of horizontal spindles 52 and 53 to which the drive from the pinion stand 14 (FIGS. 1 and 2) are connected. A quill shaft system comprises a vertical shaft 54 mounted in bearings 55 in the sub-housing and carrying a sleeve 56. The lower spindle 53 is coupled to the shaft 54 through bevel gears 57, while the upper spindle 52 is similarly coupled to sleeve 56 through bevel gears 58.

A gear 60 is keyed to the upper end of shaft 54 and meshes with an idler gear 61 which is rotatable about a vertical shaft 62 and which drives a shaft 63 through a second idler gear 64 on shaft 65 and a gear 66 keyed to shaft 63. Sleeve 56 drives shaft 65 through gear 67 keyed to the sleeve, gear 68 keyed to shaft 62 and gear 70 keyed to shaft 65. The final drive to the rolls from the shafts 63 and 65 is through a pair of very short non-splined universal spindles 71, which allow a limited degree of angular displacement. As before, adjustment of the stand in the direction of the roll axes is accompanied by changes in the angularity of the drive spindles 15.

FIG. 5 shows a modification of the top gear drive of FIG. 4, entailing fewer idler gears. Sleeve 56 now drives output shaft 65 through a gear 67A keyed to the sleeve meshing directly with gear 70 keyed to shaft 65, while shaft 54 drives output shat 63 through gear 60A keyed to shaft 54 meshing with gear 64A rotatable on shaft 65 and through gear 73 which turns on shaft 65 with gear 64A and which meshes with gear 66A keyed to shaft 63.

In the arrangement of FIG. 6, the shaft 54 and the sleeve 56 drive the output shafts 65 and 63 respectively through bevel gears, thereby avoiding the use of idler gears. Thus, shaft 54 drives through bevel gears 81 a sleeve 82 rotatable about a horizontal shaft 83, which is driven by sleeve 56 through bevel gears 84. Shaft 83 is coupled to shaft 63 through bevel gears 85, while sleeve 82 drives output shaft 65 through bevel gears 86.

Unlike the drives of FIGS. 4 to 6, the gear unit of FIG. 7, which is coupled to the stand for movement therewith, has a single input shaft 90 connected directly to one of the drive pinions 15, the drive being divided within the unit to the two output shafts 63 and 65.

Thus, input shaft 90 drives through bevel gears 91 a vertically inclined shaft 92 which in turn drives the output shaft 65 through gears 93, 94. Gears 94 and 95 are fast on shaft 65 and gear 95 meshes with a gear 96 keyed on output shaft 63.

The gear unit of FIG. 7 may be employed where the torques involved are relatively small, whereas the unit of FIG. 5 is to be preferred where the torques are higher and when usually the speeds are relatively low.

FIG. 8 shows the gear unit of one of FIGS. 4 to 7 in use with a stand 100 in vertical rolling disposition. The sub-housing 50 is mounted in a tower frame 101 in which the sub-housing is vertically adjustable to accommodate vertical adjustment of the stand 100. For the latter adjustment, the stand is mounted on wheels 102 on a lifting frame 103 which can be moved vertically by a piston and cylinder assembly 104 and bell crank levers 105. The sub-housing 50 is connected to the stand 100 through struts, one of which is shown at 106, so that the stand 100 and sub-housing 50 move together vertically. The drive from drive motor 13 through pinion box 14, spindles 15 and universal couplings 22 is similar to those shown diagramatically in FIG. 1.

The vertical adjustment of the sub-housing 50 is accompanied by alteration of the angularity of the spindles 15 as described above.

The gear units of FIGS. 4 to 8 have the merit that they can be readily traversed to any stand required to be operated in vertical disposition, and to be coupled to that stand easily and quickly. If then a maximum of four stands of a train are to be required to operate vertically, only four of the gear units are required. When the adaptors of FIGS. 1 to 3 are used, two adaptors per vertical stand are required, i.e. eight adaptors for the train. A further eight adaptors are required for the spare stands to enable them to be set up out of the mill line, unless the mill down-time inherent in removing the adaptors from the stands in the train and fitting them to the spare stands can be tolerated.

I claim:

1. Rolling mill equipment comprising:

a rolling mill housing having a pair of rolls rotatably supported therein, said housing being mounted on a support and including means for positioning the housing on said support in one orientation with the axes of the rolls horizontal and in a second orientation with the axes of the rolls vertical;

a drive motor positioned adjacent the housing;

a pair of telescopic drive spindles which are connected in driving relation with the drive motor and are connected to the ends of the respective rolls when the housing is positioned in the first orientation with the axes of the rolls horizontal; and removable adaptor means positioned adjacent the housing and supported independently of the housing, said adaptor means being displaceable between an operative position and a nonoperative position, said adaptor means in the operative position having drive means which are connected to the rolls and to at least one of the spindles when the housing is positioned in the second orientation so as to provide a drive connection between the drive motor and the rolls.

2. Rolling mill equipment according to claim 1, in which said adaptor means comprise two adaptor units each of which is adapted to transmit drive from one of said drive spindles to one of said rolls and which in use are attached to said housing one above and one below said housing.

3. Rolling mill equipment according to claim 2, in which each said adaptor unit comprises:

an input shaft connectable to a drive spindle;

a drive shaft offset from the input shaft and coupled thereto by gearing; and a sleeve adapted to receive the roll neck of one of said rolls and gearing connecting said drive shaft to said sleeve.

4. Rolling mill equipment according to claim 1, in which said adaptor means comprise: a housing coupled to said mill housing when said mill housing is positioned with the roll axes vertical; overhead spindles carried by said housing and connectable to said rolls; and gearing and shafting carried by said housing for transmitting drive from said drive spindle or spindles to said overhead spindles.

5. Rolling mill equipment according to claim 4, in which said adaptor means include:

a pair of input shafts for connection to said drive spindles;

an upstanding shaft gear-coupled to one said input shaft;

a drive sleeve rotatable about said upstanding shaft and gear coupled to the other said input shaft; and gearing arranged at the upper end of said housing and coupling said upstanding shaft and said drive sleeve to said overhead spindles.

6. Rolling mill equipment according to claim 5, in which a substantially horizontal shaft is journalled at the upper end of said housing;

a further drive sleeve is rotatably mounted on said horizontal shaft; and bevel gears connect said horizontal shaft and said further drive sleeve with, firstly, said upstanding shaft and said first drive sleeve and with, secondly, said two overhead drive spindles.

7. Rolling mill equipment according to claim 4, in which said adaptor means comprise a single upwardly-directed shaft gear-coupled firstly to an input shaft connectable to one of said drive spindles and secondly to shafts connected with said overhead spindles.

8. Rolling mill equipment according to claim 4, in which said housing is adjustably mounted in a tower frame and is connectable to said mill housing when the roll axes are vertical, so that the housing is caused to move when the vertical positioning of said mill housing is adjusted.

* * * * *